US005340239A

United States Patent [19]

van den

[11] Patent Number: 5,340,239

[45] Date of Patent: Aug. 23, 1994

[54] INSTALLATION FOR CARRYING OUT EXPERIMENTS UNDER THE CONDITION OF WEIGHTLESSNESS OR MICROGRAVITY

[76] Inventor: Berk van den, Rychenbergstrasse 203, CH 8404-Winterthur, Switzerland

[21] Appl. No.: 948,085

[22] Filed: Sep. 21, 1992

[30] Foreign Application Priority Data

Sep. 26, 1991 [CH] Switzerland ..... 2848/91

[51] Int. Cl.[5] ..... E02B 17/00

[52] U.S. Cl. ..... 405/224; 405/195.1; 405/303

[58] Field of Search ..... 405/195.1, 202, 224, 405/203, 303; 114/264, 265

[56] References Cited

U.S. PATENT DOCUMENTS 4,231,682 11/1980 Tuson ..... 405/202

4,813,815 3/1989 McGehee ..... 405/202

OTHER PUBLICATIONS

Zarm Zentrum fur Angewandte Raumfahrttechnologie und Mikrogravitat, 2nd edition, Aug. 1990, pp. 10, 11.

Microgravity Science and Technology, Feb. 1991, pp. 251, 252.

*Primary Examiner*—David H. Corbin

[57] ABSTRACT

The installation for carrying out experiments under the condition of weightlessness or microgravity comprises a drop tube immersed in water with its end closed by a bottom. The upper end of the tube carries a service room above the surface of the water. The drop tube is connected to the floor of the water by means of an anchor chain connected to the tubes bottom and an anchor. The tube is kept in upright position by the buoyant force of the water and its tensioned anchor chain. A carriage in the service room can be positioned over the center of the orifice of the tube carrying a drop capsule with an experimental set-up. After releasing the capsule from the carriage it drops down through the tube in free fall. During the fall the experimental set-up is in the state of weightlessness the experiment being influenced accordingly. At the end of its free fall the capsule is caught by a catcing device and subsequently lifted back into the service room by means of a windlass.

14 Claims, 2 Drawing Sheets

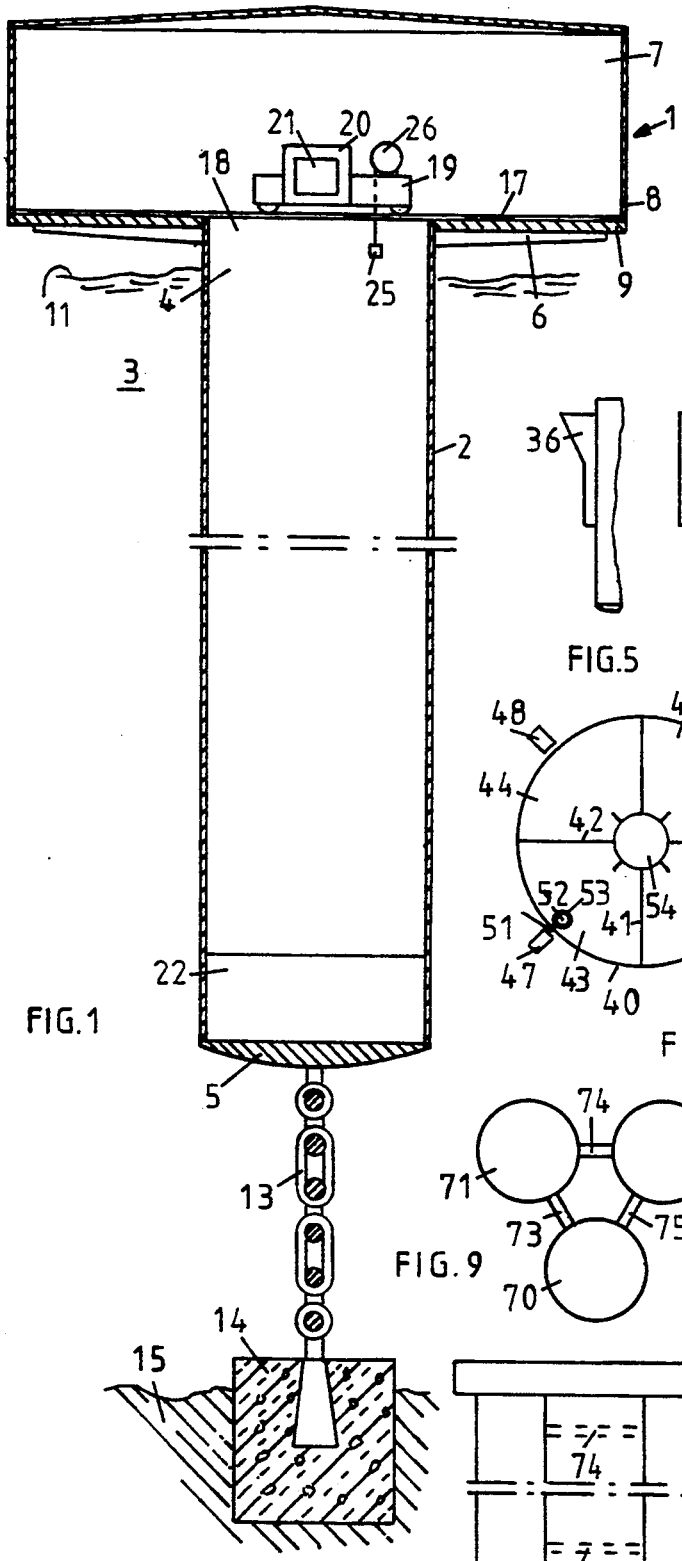
FIG.1
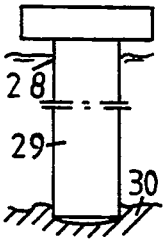
FIG.2
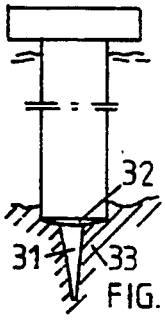
FIG.3
FIG.5
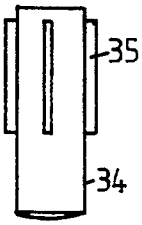
FIG.4
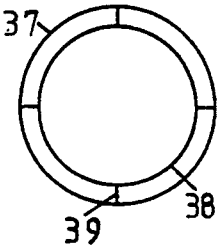
FIG.6
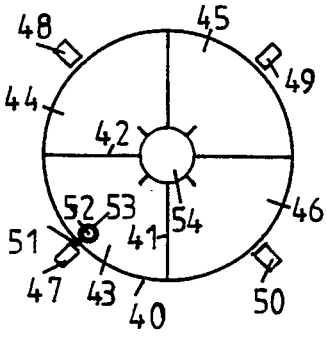
FIG.7
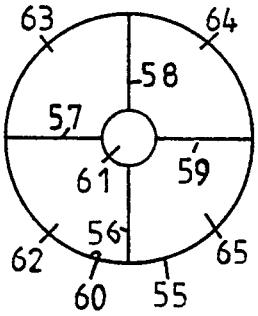
FIG.8
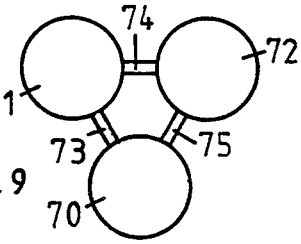
FIG.9
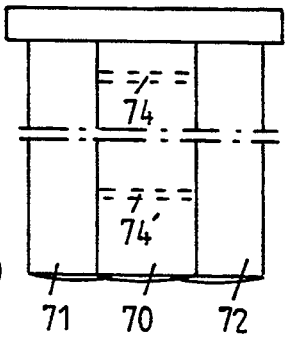
FIG.10
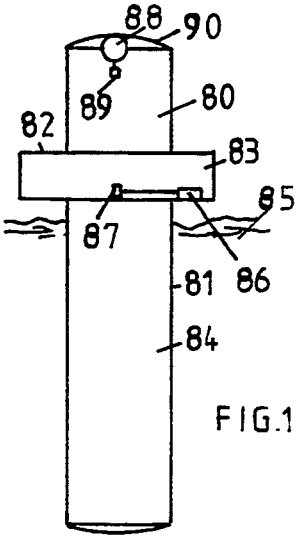
FIG.11

INSTALLATION FOR CARRYING OUT EXPERIMENTS UNDER THE CONDITION OF WEIGHTLESSNESS OR MICROGRAVITY

BACKGROUND OF THE INVENTION

The invention relates to an installation for carrying out experiments under the condition of weightlessness or microgravity by means of a drop capsule and a drop tube.

Under the condition of weightlessness or microgravity certain physical influences are very strongly weakened;others appear more clearly no longer being obscured by gravitational forces. The condition of weightlessness obtaing in free fall is characterized by the absence of gravity-induced convection, hydrostatic lift and sedimentation. This is very important in the evaluation of processes in fluid physics, material and life sciences and combustion processes.

A condition of weightlessness of long duration as is required for several experiments obtains only aboard a space ship. A disadvantage is that the cost of an experiment is very high and that the necessary continuity required for many experiments cannot be realized in this way. Therefore, first of all terrestrial installations are necessary enabling carrying out orientating experiments economically whose results may then be used for the final experiment aboard a space ship. In this way the number of guest flights can be reduced considerably. Also, science and industry require timelessness of access to an installation to prepare and carry out their experiments. The lead time for experiments aboard a space ship may be several years.

It is known to carry out experiments under the condition of weightlessness by means of a drop tower (Microgavity Science and technology. III/4, February 1991, pages 251,252). The tower has a height of approx. 146 m, a diameter of approx. 8.5 m, the drop tube proper being arranged concentrically therein and having a diameter of approx. 3.5 m. The tower serves to support the drop tube and to withstand the wind forces. A service room is located underneath the drop tube an extension of the tube underneath the room containing a device to catch the capsule at the end of its free fall. A disadvantage of the installation is that due to its great height and the extensive fundament its cost of erection is high increasing overproportionally with height. The erection time is long. Due to its great height the tower spire swings already rather much at relativeky low wind velocities. Computer controlled means are required to release the capsule at the right moment from the carriage to begin its free fall. A further disadvantage is that due to its great height the tower is perceived by many people as too dominant and a disturbing object in the landscape.

With a view to the furtherance of space flight and its industrial uses it is desirable that more installations for such experiments are available. However, it should be possible to build them at low cost. Also, the height of the installation is limited costwise,viz. the duration of the condition of weightlessness is accordingly short.

OBJECTS OF THE INVENTION

It is an object of the invention to provide an installation for carrying out experiments under the condition of weightlessness whose cost of erection is relatively low.

It is a further object of the invention that the installation can be erected in a short time.

It is a still further object of the invention that the installation is not exposed to wind forces.

A still further object of the invention is an installation that does not dominate the landscape.

According to the invention the installation for carrying out experiments under the condition of weighlessness or microgravity is comprised of a drop tube closed at the bottom and immersed in water, for example, in a rather deep lake or in a rather quiet region of a sea. The tube emerges from the water carrying above the water level a service room. The tube is connected at its closed end to the water floor by means of an anchor chain and an anchor. The tube is kept perpendicular by the buoyant floor of the water and its tensioned anchor chain. A carriage in the service room releasably supports a drop capsule containing an experimental arrangement. A catching device provided in the lower portion of the tube brings the capsule to a standstill at the end of its free fall. Then the capsule is lifted back into the service room for evaluation of the experiment.

BRIEF DESCRIPTION OF THE DRAWINGS

FIG. 1 is a cross-section of a first embodiment of the installation according to the invention.

FIG. 2 is a front view of an installation which is anchored in the water floor.

FIG. 3 is a front view of an installation which is anchored in the water floor by means of a supporting pillar.

FIG. 4 is a front view of a drop tube provided with reinforcing ribs.

FIG. 5 is a front view of another embodiment of a reinforcing rib.

FIG. 6 is the top view of a drop tube surrounded by a reinforcing tube.

FIG. 7 is the top view of an installation comprising four drop tubes.

FIG. 8 is the top view of an installation comprising four drop tubes and a central elevator.

FIG. 9 is the top view of an installation comprising three separate drop tubes.

FIG. 10 is a front view of the installation of FIG. 9.

FIG. 11 is a front view of an installation partly immersed in water and partly emerging from the water.

DESCRIPTION OF THE EMBODIMENTS

Figure 12:
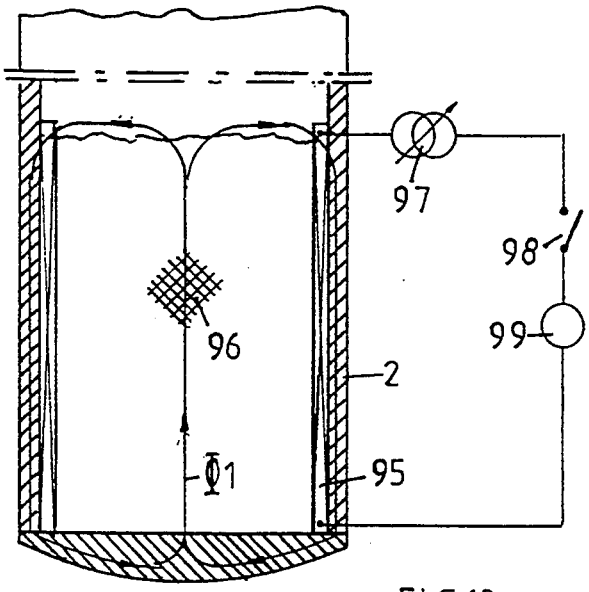
FIG. 12 is the cross-section of the catching device in the drop tube of the installation according to FIG. 1.

The installation 1 according to FIG. 1 comprises a drop tube 2 immersed perpendicularly in a water, for example, in a deep lake 3 or in a coastal water. It is open at its upper end 4 and closed at the lower end by a bottom 5. The upper end of the tube emmerges from the water carrying above the water level a service room 7 with a circular outer wall 8 and a floor 9 resting on radial beams 6. Thus, the room is located above the water level so that the installation is not disturbed by movements of the surface of the water. The tube is anchored to the floor 15 of the water 3 by means of an anchor chain 13 and a concrete anchor 14 in the floor.

The displacing volume of the tube as determined by its diameter and depth in the water is such that considering the total weight of the installation the resulting buoyant force is so large as to tension the anchor chain keeping the tube in perpendicular position. Since already 10 m below its surface the water is practically staionnary and the hydraulic pressure on the tube, particularly on its lower end, being high —1 bar/1O m of depth—the installation stands fixed and motionless in the water. Surface waves do not influence the stability of the installation. Two rails 17 in the service room 7 traverse the orifice 18 of the tube 2 diametrically. A carriage 19 on the rails support a drop capsule 20 containing an experimental set-up 21. A catching device 22 near the lower end of the tube serves to catch the capsule and brake it to standstill. When preparing the experiment the carriage 19 is located on the floor of the service rom. The vacuum pumps in the room are in operation to evacuate the drop tube when necessary.

In order to start the experiment the carriage 19 is driven over the orifice 18 of the drop tube 2 such that the capsule 20 is located in its center. Then the capsule is released from the carriage by remote control so that it drops into the drop tube. During its fall the capsule and with it the experimental set-up is in the state of weightlessness or microgravity the experiment being influenced accordingly. Near the end of its free fall the capsule is caught and braked to standstill by the catching device 22. Subsequently, the wind lass 26 on the carriage 19 lowers a lifting magnet 25 onto the capsule and lifts it back to the service room. The carriage is driven sideways into the service room for evaluation of the experiment.

In the embodiment according to FIG. 2 the weight of the installation 28 exceeds the buoyant force on its drop tube 29, so that it penetrates the floor 30 anchoring itself therein. The anchoring of an installation may be made stronger by means of a tapering pillar 31 extending downward from the floor 32 of the drop tube penetrating the water bottom 33 by its weight. FIG. 3.

In order to stiffen the drop tube reinforcing ribs 35 may be applied at its circumference 34. FIG. 4. According to FIG. 5 the reinforcing ribs 36 are enlarged radially serving as stabilizing ribs at the same time, if necessary. The reinforcement of the drop tube 38 may also be obtained by means of a tube 37 surrounding it concentrically and being connected to it by means of radial bridges 39. FIG. 6.

The embodiment according to FIG. 7 comprises a tube 40 of large diameter which is divided into four sectors by diametrical partition walls 41 and 42 each sector constituting a drop tube 43,44,45,46 and having one service room in common. The installation enables similar experiments to be carried out with different parameter or different experiments simultaneously. Each drop tube is provided with a linear control motor 47,48,49,50 located in the service room (not shown) for each capsule and a catching device (not shown). The actuating rod of each control motor, for example, the rod 51 of control motor 47, supports a capsule 53 and is provided with a release mechanism 52 for the capsule. In operation the control motor moves the capsule to the midst of the drop tube 43 where it is released for its free fall. The three other capsules are handled in the same way. A centrally located windlass 54 having four lifting cables pulls the capsule out of the pertaining catching device lifting it back into the service room.

The embodiment according to FIG. 8 is comprised of a tube 55 with four partition walls 56,57,58,59 extending diametrically between its inner wall 60 and a central tube 61 resulting in four separate drop tubes 62,63,64,65. The central tube 61 accomodates an elevator (not shown) for all four capsules of all four drop tubes. To this end the central tube is provided with an orifice facing each catching device giving access for a capsule to the elevator. Each capsule leaves its catching device on a glide leading to the cabin of the elevator.

The embodiment according to FIGS. 9 and 10 comprises three drop tubes 70,71,72 interconnected by means of bridges 73,74,75 at vertical intervalls. The result is a multiple installation of large capacity which is very rigid and stable at the same time.

The embodiment of the installation according to FIG. 11 is comprised of a drop tube immersing partially in the water and emersing partially from the water. The upper part 80 of the drop tube 81 penetrates the roof 82 of the service room 83 the lower part 84 being in the water 85. In the service room a linear control motor 86 drives the capsule 87 to the center of the drop tube 84. A windlass 88 with releasing device 89 underneath the roof 90 of the upper part 80 of the drop tube takes over the capsule from the control motor 86 lifting it upwards toward the roof. As soon as the actuating rod of the control motor has returned to its starting position, the capsule is released falling through the complete height of the drop tube. The advantage of the embodiment is that it may be erected in waters of less depth. For example, $\frac{2}{3}$ of the drop tube may be in the water, $\frac{1}{3}$ above the water level.

With all embodiments described and shown the service room may float on the water supporting the whole weight of the drop tube or part of it.

To all embodiments applies that the drop tube may be made with incrasing wall thickness with increasing depth in the water.

The drop tubes described so far are made of steel, for example, for example in the form of steel rings welded together. It is possible, however, to make the drop tube of reinforced concrete.

Provided the water is sufficiently deep a drop tube of great depth and according longer duration of the state of weightlessness can be built with little additional cost. Also, at moderate cost a drop tube of large diameter may be constructed enabling the use of a large capsule accomodating a large experimental set-up.

As a possible erection method for the installation according to FIG. 1, aboard a ship or on a pier, first a steel ring is provided with a bottom and an anchor. The ring is put overboard by means of a crane and lowered so deep into the water that the upper rim of the ring is still above the water level. Subsequently, so many rings are welded one on top of the other that the anchor reaches the water floor. Finally, the pre-built service room is lowered onto the upper ring by a crane, or otherwise, the service room is constructed on the top ring. The catching device, which may be a column of styropor granulate, is poured into the drop tube.

Figure 13:
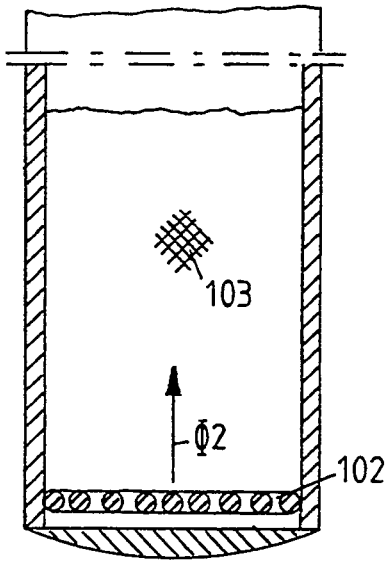
FIG. 13 is the cross-section of a further embodiment of a catching device.

The catching device 22 in the drop tube 2 of the installation according to FIG. 1 is comprised of a cylindrcal magnetic coil 95 on the inner wall of the drop tube surrounding a column of magnetizable styropor granulate. FIG. 12. The current supply leads for the coil run along the inner or outer wall of the drop tube and upwards to the service room 7. In the service room the cables are connected with an electric power supply 99 via a variable transformer 97 and a switch 98. When excited the coil generates a magnetic field $\Phi_1$ permeating the granulate axially and magnetizing the particles sticking together now. The particles stick the stronger together the higher the excitation current their flowability decreasing and their braking action on the immersing capsule increasing. By controlling the current the braking action can be adapted to the size and mass of the capsule. The magnetic field $\Phi_1$ forms a closed loop through the wall and the bottom of the drop tube. The magnetizability of the granulate may be obtained by coating them with a ferromagnetic material, for example, nickel, evaporated in a fluidized bed. A similar braking action may be obtained by means of a flat coil 102 on the bottom of the drop tube, whose magnetic field $\Phi 2$ permeates the granulate 103 from bottom to top decreasing in strength upwardly. FIG. 13.

Figure 14:
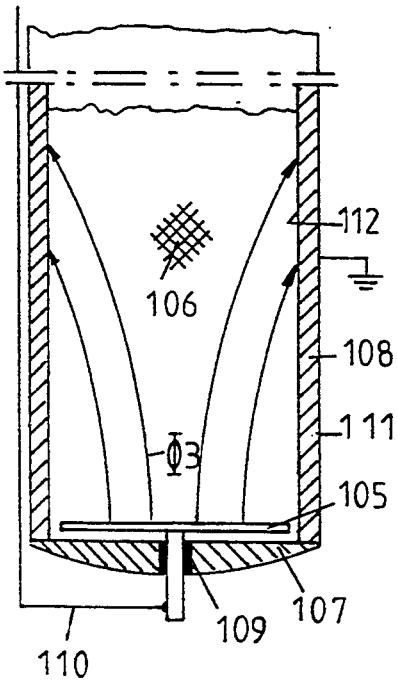
FIG. 14 is the cross-section of a still further embodiment of a catching device.
Figure 15:
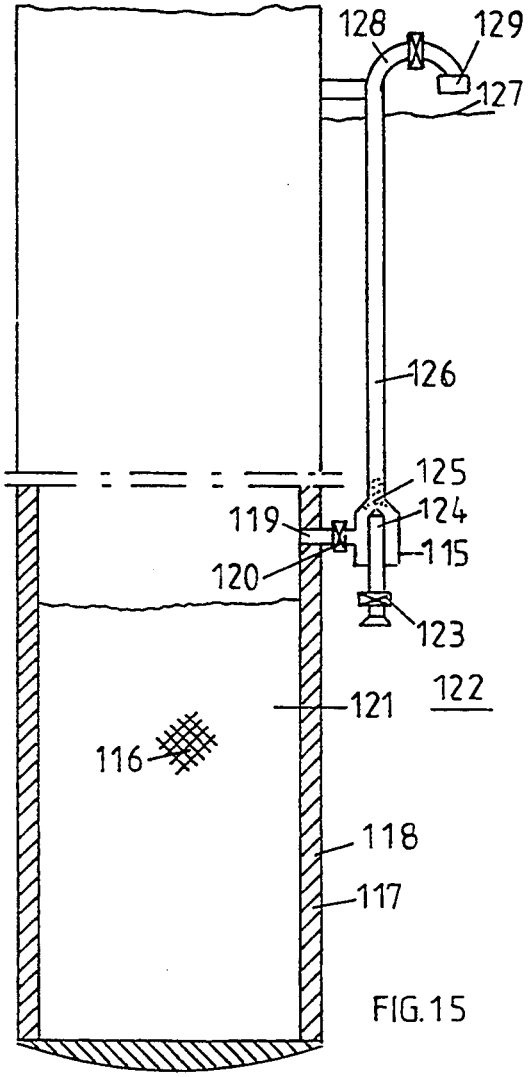
FIG. 15 is a part cross-section of a drop tube provided with a vacuum pump.

Instead of a magnetizable granulate a magnetizable fluid may be used whose viscosity changes under the influence of a magnetic field. With the embodiment according to FIG. 14 the catching device is comprised of a disc electrode 105 and an electroviscous fluid 106 increasing in viscosity with increasing voltage. The disc electrode is isolated from the bottom 107 of the drop tube 108 and connected to a conductor 110 via an insulator 109. The conductor runs along the outer wall 111 of the drop tube to a variable voltage source in the service room. The field lines of the field $\Phi 3$ permeate the liquid terminating on the inner wall 112 of the drop tube. With increasing voltage the braking action of the liquid on the immersing capsule increases.

The weightlessness of the capsule in free fall is optimal when no air resistance is acting on it. For this reason the drop tube has to be evacuated most of the time. This is done by means of ejector pump 115 mounted at the outer wall 117 of the drop tube 118 little above the granulate 116. The pump is connected with the inner space 121 of the drop tube via a suction tube 119 and a valve 120. The driving liquid of the pump is the water 122 surrounding the drop tube with high pressure. The water is admitted to driving nozzle 124 of the pump by means of a valve 123 remotely controlled from the service room. The resulting air-water mixture 125 produced by the pump flows through the tube 126 to the surface of the water where it exits through the bent end 128 of the tube. The water-air mixture being considerably lighter than the surrounding water 122 the pressure head is high. In order to prevent water entering the tube 126 when the pump is not in operation the end 128 of the tube is provided with a snorkel 129. The evacuation of the drop tube may be enhanced by means of vacuum pumps located in the service room. More than one ejection pump may be mounted along the circumference of the drop tube in order to increase the pumping capacity and to ready the installtion sooner for operation.

What I claim is:

1. An installation for carrying out experiments under the condition of weightlessness or microgravity, comprising:

a drop tube having an open end and an end closed by a bottom;

said drop tube being immersed in an earth water its bottom being in the water;

said drop tube being anchored to the floor of said earth water to keep said drop tube in a perpendicular position;

supporting means to support a drop capsule containing an experimental set-up destined to be exposed to the condition of weightlessness;

means to release said drop capsule from said supporting means to start its free fall down said drop tube;

catching means in said drop tube to catch said drop capsule at the end of its free fall; and lifting means adapted to lift said drop capsule back to said open end of said drop tube.

2. The installation according to claim 1 wherein said drop tube is divided into sectors by means of partition walls each sector constituting a separate drop tube.

3. The installation according to claim 1 wherein said drop tube includes a central elevator, partitions extending between said elevator and the inner wall of said drop tube constituting separate drop tubes.

4. The installation according to claim 1 wherein said drop tube carries a service room near its open end located above the surface of said earth water.

5. The installation according to claim 1 wherein said drop tube is anchored by means of an anchor chain extending between said bottom and an anchor on the floor of said earth water.

6. The installation according to claim 1 wherein said drop tube is provided with radially extending reinforcing ribs.

7. The installation according to claim 1 wherein said drop tube is surrounded by a concentric reinforcing tube connected thereto by means of bridges.

8. The installation according to claim 1 wherein a lower portion portion of said drop tube is immersed in said water, its upper portion arising above said water, the service room being located in between said upper and said lower portion.

9. The installation according to claim 1 wherein said drop tube is connected to at least one other drop tube, the drop tubes having one service room in common.

10. The installation according to claim 1 wherein said drop tube rests with its bottom on the water floor.

11. The installation according to claim 1 wherein said catching means comprise a column of magnetizable styropor granulate and a magnetic coil surrounding said granulate.

12. The installation according to claim 1 wherein said catching means comprise a magnetizable fluid and a magnetic coil surrounding said fluid.

13. The installation according to claim 1 wherein said catching means comprise an electroviscous fluid and an electrode disposed to permeate the fluid with its electrostatic field.

14. The installation according to claim 1 wherein said drop tube at its circumference is provided with at least one water-injection pump, whose suction side is connected with the tube and whose driving liquid is the water is surrouding the tube, the exit tube of the pump leading to above the surface of the water.

* * * * *

UNITED STATES PATENT AND TRADEMARK OFFICE

CERTIFICATE OF CORRECTION

PATENT NO. : 5,340,239

DATED : August 23, 1994

INVENTOR(S) : Henry Van Den Berk

It is certified that error appears in the above-indentified patent and that said Letters Patent is hereby corrected as shown below:

On the title page, under item [19], "van den" should be -- van den berk--; and in item [76] "Berk van den" should be--Henry van den Berk--.

Signed and Sealed this

Eighth Day of November, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,340,239
DATED : Aug. 23,1994
INVENTOR(S) : Henry Van Den Berk

It is certified that error appears in the above-indentified patent and that said Letters Patent is hereby corrected as shown below:

column 2, line 16: change "floor" to "force"

Signed and Sealed this

Third Day of January, 1995

*Attest:*

*Attesting Officer*

BRUCE LEHMAN

*Commissioner of Patents and Trademarks*